US007172472B2

(12) United States Patent
Fujii

(10) Patent No.: US 7,172,472 B2
(45) **Date of Patent: *Feb. 6, 2007**

(54) JOINT CONNECTOR, A JOINT TERMINAL, AND A PRODUCTION METHOD FOR JOINT TERMINAL

(75) Inventor: Masayasu Fujii, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/961,668

(22) Filed: Oct. 8, 2004

(65) Prior Publication Data

US 2005/0079758 A1 Apr. 14, 2005

(30) Foreign Application Priority Data

Oct. 10, 2003 (JP) ..... 2003-352481

(51) Int. Cl.
*H01R 9/16* (2006.01)

(52) U.S. Cl. ..... 439/869; 439/884; 439/733.1

(58) Field of Classification Search ..... 439/869, 439/701, 884–885, 888–907, 507, 928, 594, 439/651, 222–224, 733.1, 608
See application file for complete search history.

(56) References Cited

U.S. PATENT DOCUMENTS 5,060,372 A * 10/1991 Capp et al. ..... 29/883
6,319,071 B1 * 11/2001 Sato ..... 439/701
6,332,811 B1 * 12/2001 Sato ..... 439/701
6,447,331 B1 * 9/2002 Fukatsu et al. ..... 439/516
6,637,106 B2 * 10/2003 Sato et al. ..... 29/878
6,814,627 B2 * 11/2004 Yamamoto et al. ..... 439/701

FOREIGN PATENT DOCUMENTS

JP 9-115612 5/1997

* cited by examiner

*Primary Examiner*—Truc T. Nguyen
*Assistant Examiner*—Edwin A. Leon
(74) *Attorney, Agent, or Firm*—Gerald E. Hespos; Anthony J. Casella

(57) ABSTRACT

A joint terminal (20*c*) has a coupling (41) that initially is substantially parallel with a carrier (51). The coupling (41) has an intermediate portion (45) joined to the carrier (51) by an extension (52) and is held substantially coplanar with the carrier (51). The coupling (41) is bent on opposite ends of the intermediate portion (45) while the intermediate support (45) and the carrier (51) are being held to define a first support (43) that support first tabs (42) and a second support (44) that supports second tabs (22).

2 Claims, 12 Drawing Sheets

JOINT CONNECTOR, A JOINT TERMINAL, AND A PRODUCTION METHOD FOR JOINT TERMINAL

BACKGROUND OF THE INVENTION

1. Field of the Invention

The invention relates to a joint connector for shorting a plurality of terminal fittings, a joint terminal forming the joint connector and a production method for joint terminal.

2. Description of the Related Art

Japanese Unexamined Patent Publication No. H09-115612 discloses a joint terminal that has tabs projecting from a plate-shaped coupling that has been bent into substantially U-shape. The joint terminal is mounted in a housing made of a synthetic resin to define a joint connector for shorting terminal fittings arranged at upper and lower stages. The coupling is comprised of an upper support for supporting the tabs to be connected with terminal fittings at the upper stage, a lower support for supporting the tabs to be connected with the terminal fittings at the lower stage, and an intermediate portion coupling the upper and lower supports.

The above-described joint terminal with tabs projecting from a substantially U-shaped coupling could be made from chained terminals that have tabs supported on a long narrow carrier. The chained terminals could then be fed parallel with the longitudinal direction of the carrier, and a leading section of the chained terminals with respect to feeding direction could be bent into a substantially U-shape. This bent section then could be cut off from the chained terminals. Specifically, the upper support would be formed first by bending a leading end of the chained terminals substantially at right angles. The chained terminals would be bent again substantially at right angles at a position more backward than the first bend with respect to feeding direction to form the intermediate portion. An area behind the second bend then would become the lower support. In this way, the substantially U-shaped coupling portion is formed.

Successively bending the leading section of the chained terminals twice with respect to feeding direction can provide high dimensional precision when a special press machine performs the bending. However, dimensional precision is difficult to obtain if the double bending is performed by an automatic mounting machine for mounting an already-produced joint terminal in a housing.

The invention was developed in view of the above problems and an object is to enable the production of a joint terminal with high precision even in an automatic mounting machine for mounting a joint terminal into a housing.

SUMMARY OF THE INVENTION

The invention relates to a joint terminal for shorting a plurality of terminal fittings arranged at least at two stages. The joint terminal has tabs that project from a substantially plate-shaped coupling. The coupling is bent into a selected nonplanar shape, such as an L-shape, a U-shape or an S-shape. The coupling is substantially parallel with a carrier before being bent and has an intermediate portion between a first support that supports at least one tab at the first stage and a second support that supports at least one tab at the second stage. The intermediate portion of the coupling is coupled to an extension that extends from a lateral edge of the carrier. The first and second supports are bent at an angle to the intermediate portion while the intermediate portion and the extension are held substantially flush with and coplanar with the carrier. The coplanar and flush retention of the intermediate portion with the carrier ensures that a high dimensional precision can be obtained even when the bending is applied at an automatic mounting machine for mounting a joint terminal into a housing.

The coupling portion preferably is bent while chained terminals are supported for being fed parallel with the longitudinal direction of the carrier.

The tabs preferably are separated from the carrier in the chained terminals. Thus, the tabs need not be cut off from the carrier upon bending the coupling.

A lateral edge of the coupling preferably is cut out, recessed or thinned at or near a boundary between the intermediate portion and the first support and/or at or near a boundary between the intermediate portion and the second support, thereby forming at least one recess. As a result, bending resistance is reduced and the bending can be performed with high precision.

The extending portion and the intermediate portion preferably are cut off from each other along a line substantially connecting the inner sides of the recesses. As a result, the cutting surface is more inward than the lateral edge of the coupling after the intermediate portion is cut off from the extending portion. Accordingly, any burrs created on the cutting surface do not project out beyond the lateral edge of the coupling.

The invention also relates to a joint connector for shorting terminal fittings arranged at least at two stages in a mating connector. The joint connector includes a housing and the above-described joint terminal.

The invention also relates to the above-described method for producing a joint terminal.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
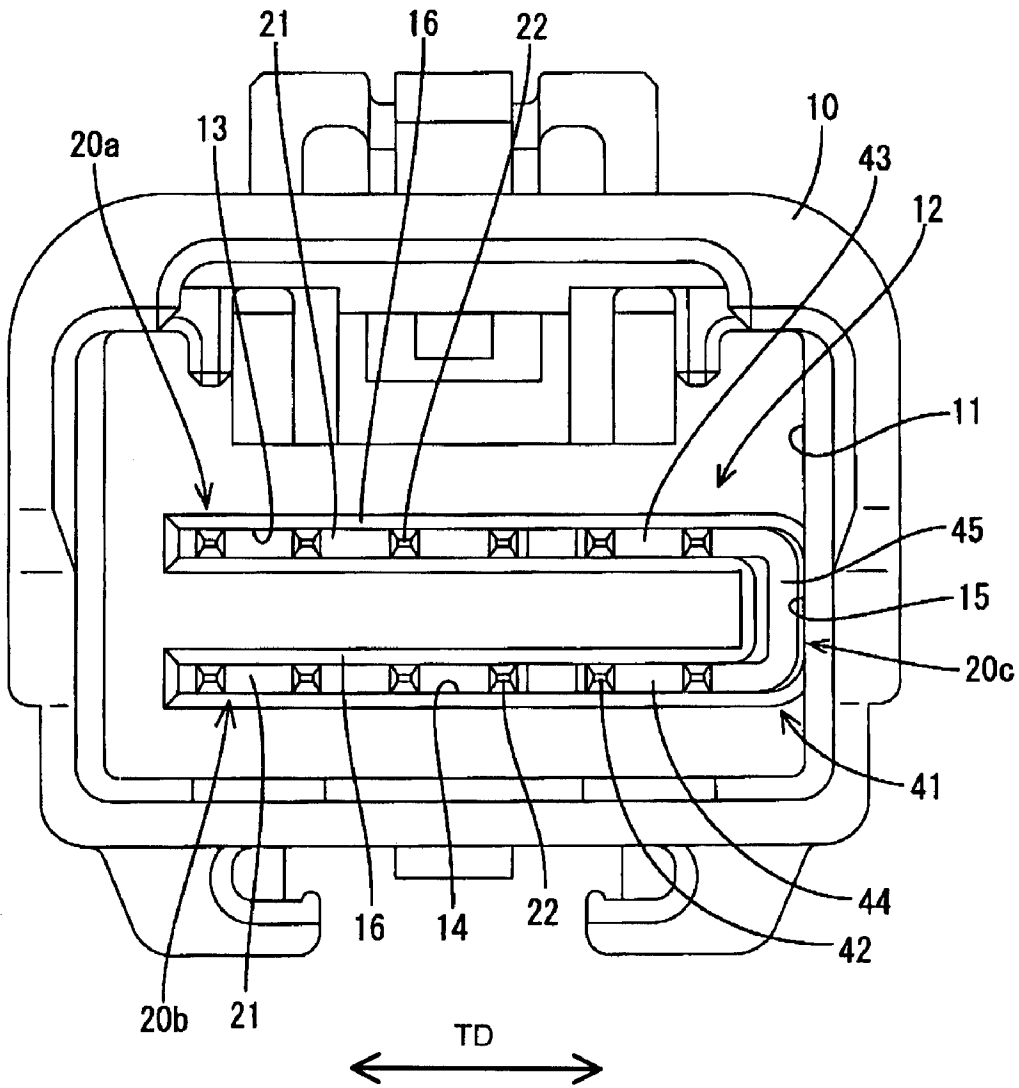
FIG. 1 is a front view of a joint connector according to one embodiment.
Figure 2A:
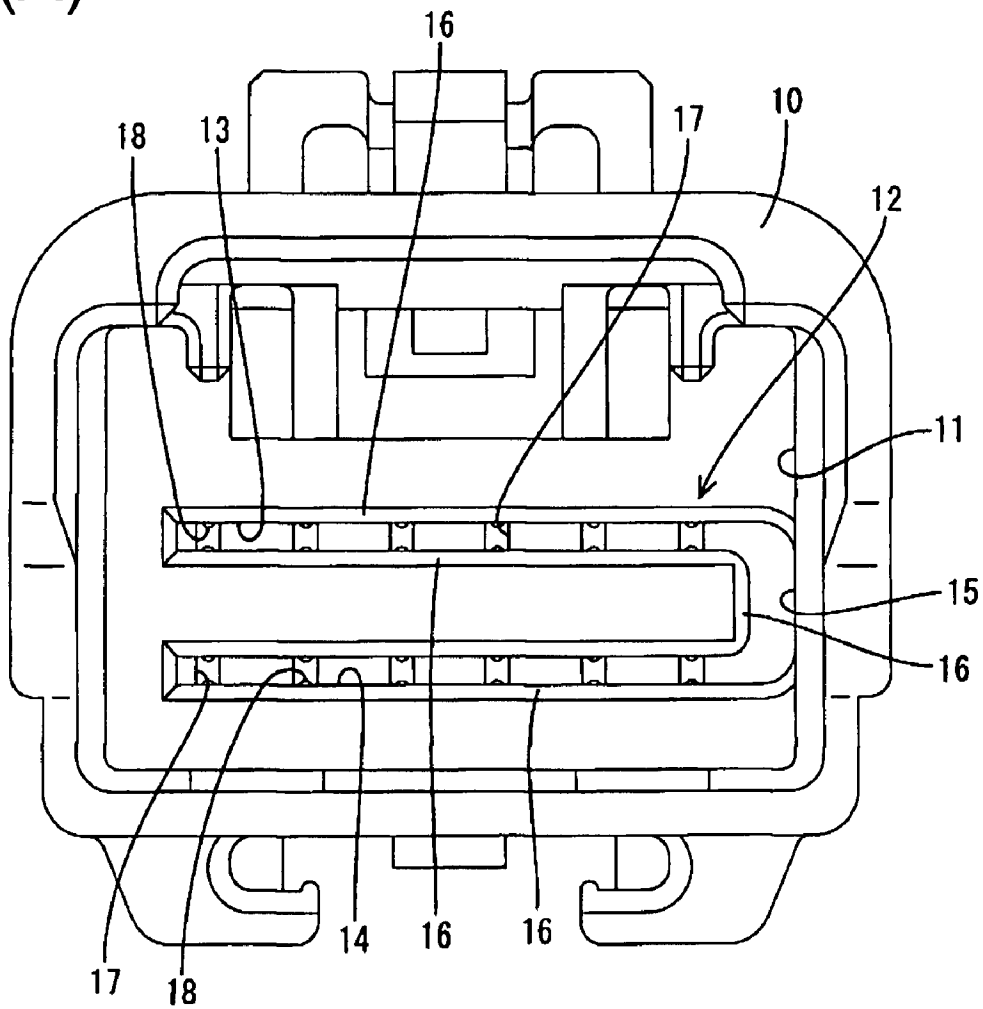
FIG. 2(A) is a front view of a housing showing a state before joint terminals are pressed into.
Figure 2B:
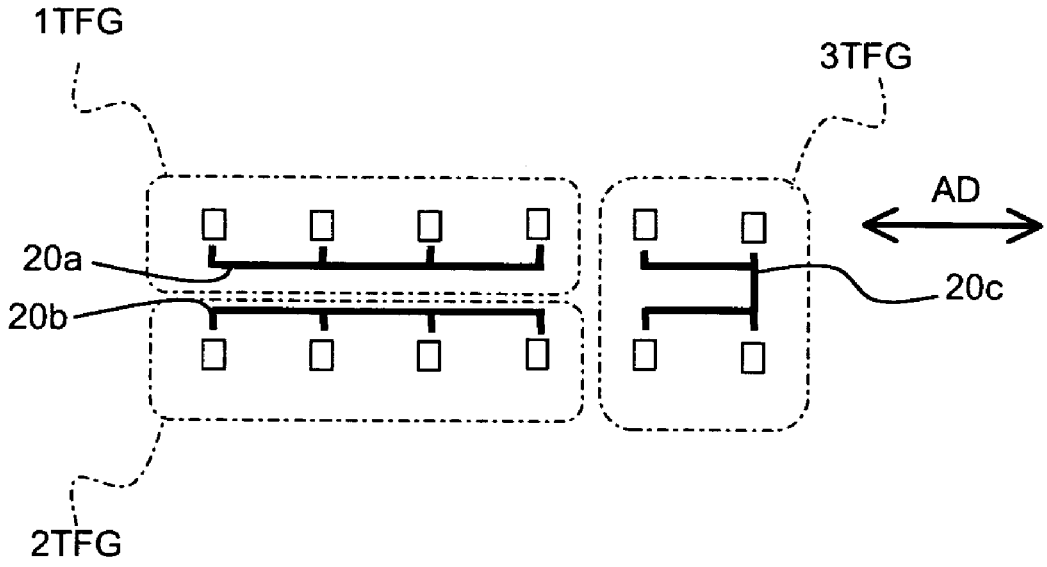
FIG. 2(B) is a schematic drawing showing the shorted terminal fitting groups.
Figure 3:
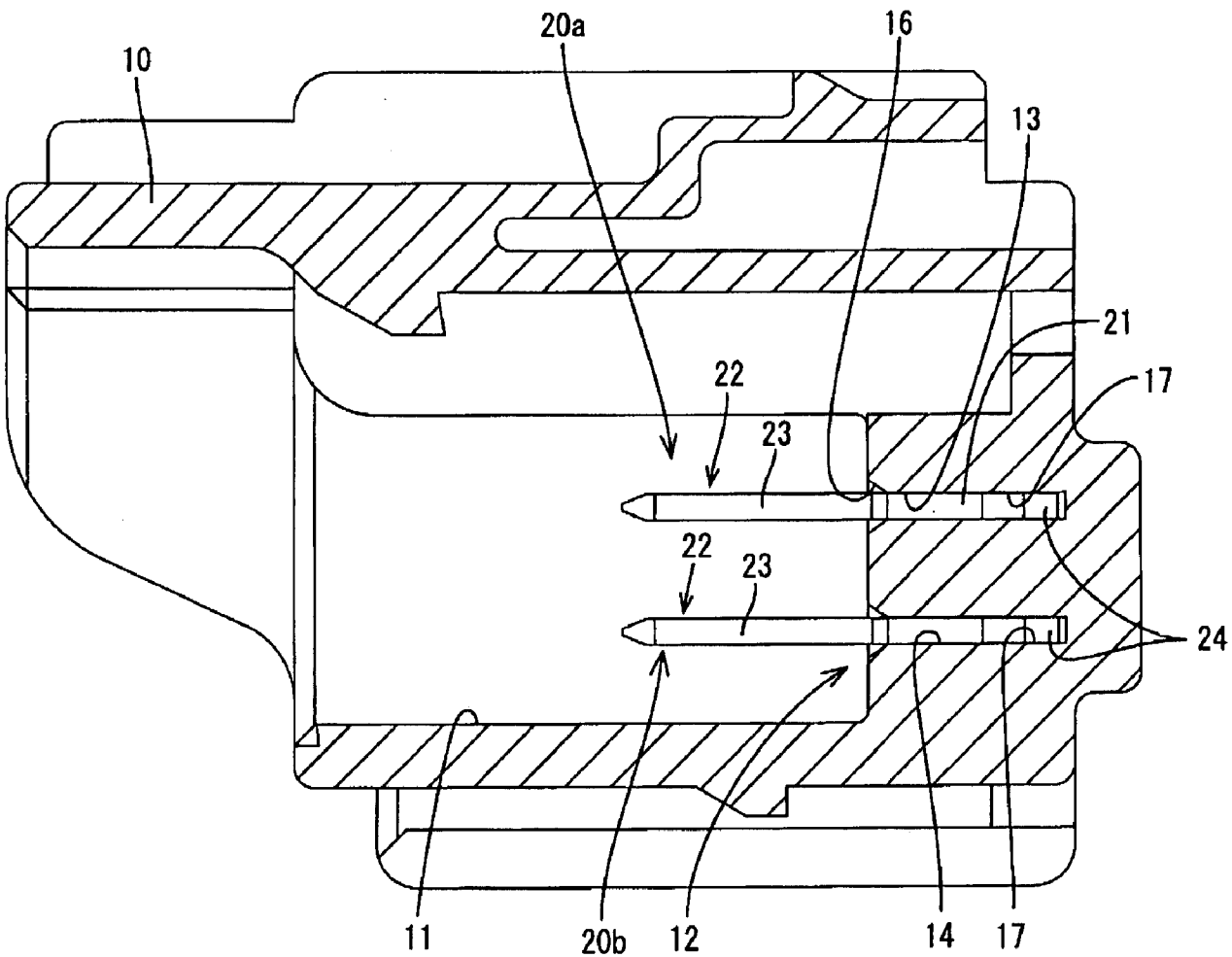
FIG. 3 is a vertical section of the joint connector.
Figure 4:
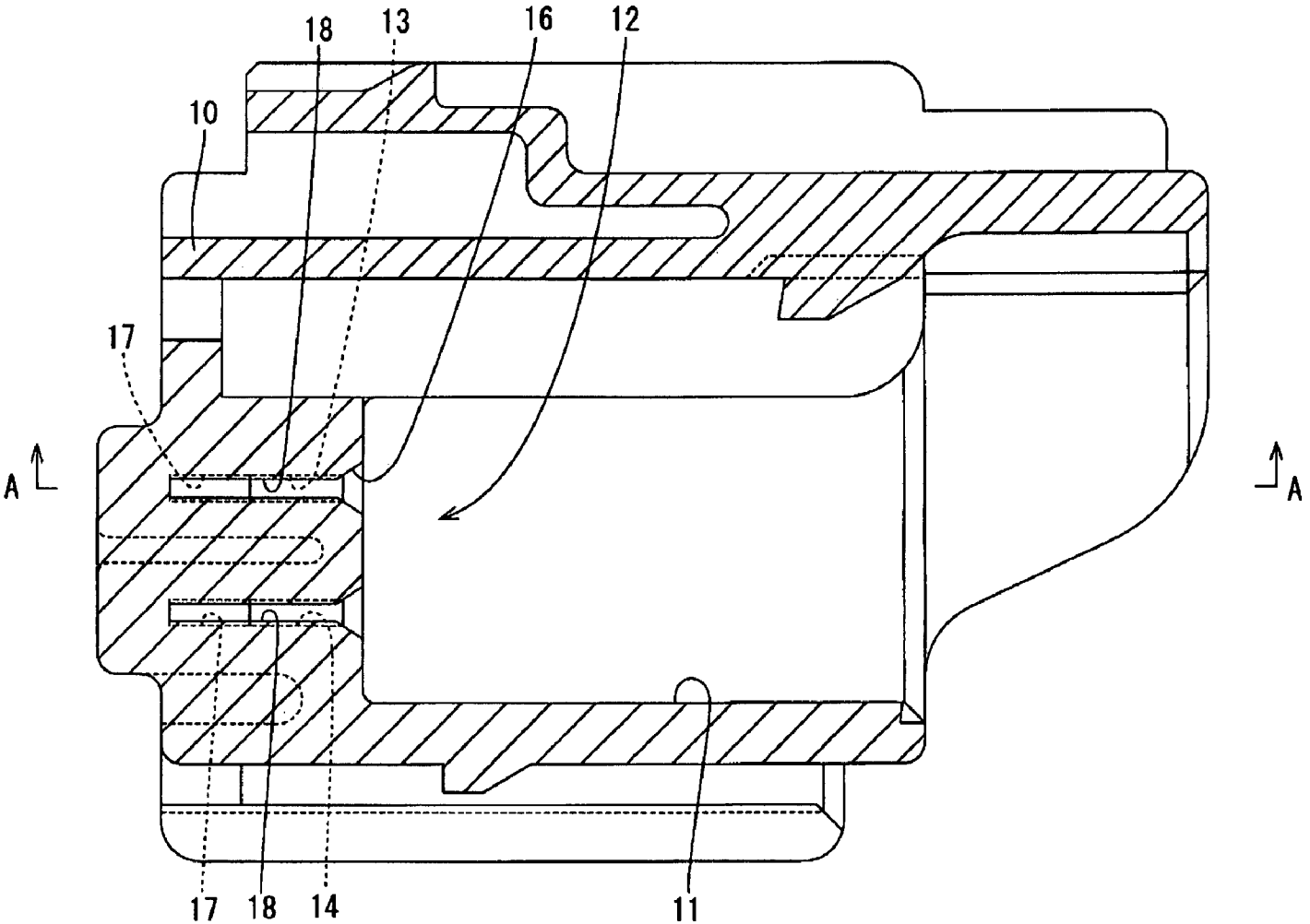
FIG. 4 is a vertical section of the housing showing the state before the joint terminals are pressed into.
Figure 5:
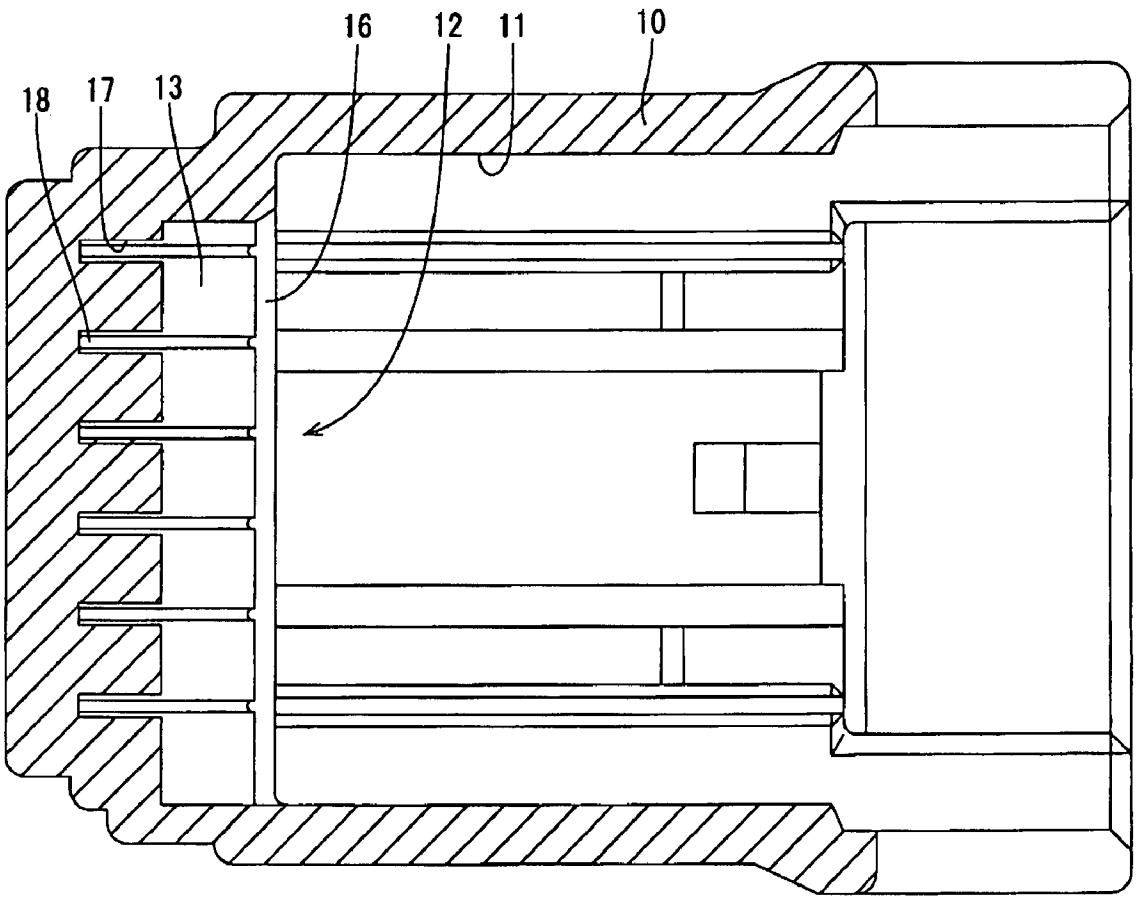
FIG. 5 is a section along 5—5 of FIG. 4.
Figure 6:
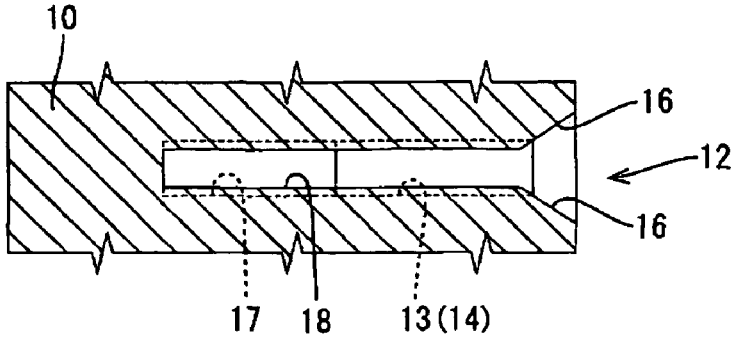
FIG. 6 is a partial enlarged vertical section of a press-in groove.
Figure 7:
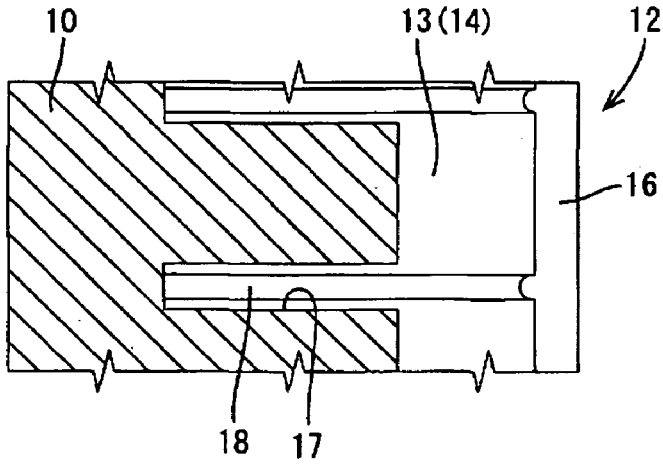
FIG. 7 is a partial enlarged horizontal section of the press-in groove.
Figure 8:
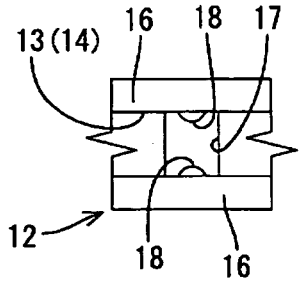
FIG. 8 is a partial enlarged front view of the press-in groove.
Figure 9:
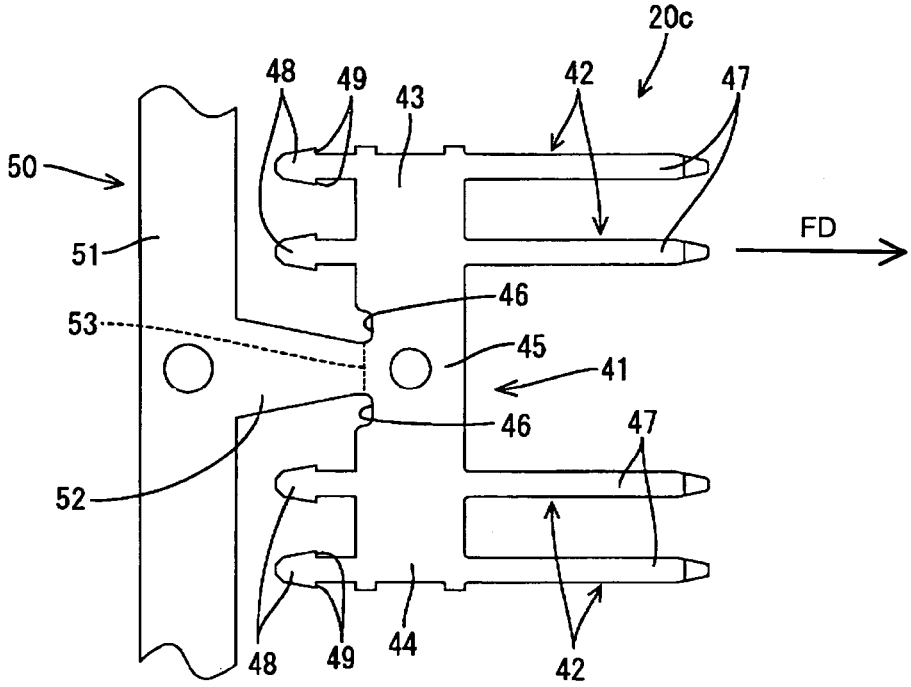
FIG. 9 is a plan view of chained terminals.
Figure 10:
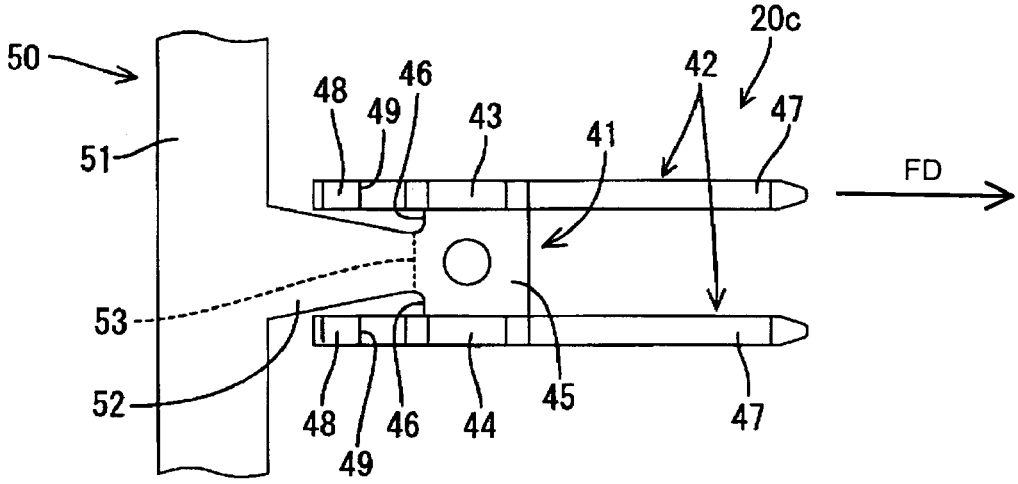
FIG. 10 is a plan view showing a state where a coupling portion of a third joint terminal is bent in the chained terminals.
Figure 11:
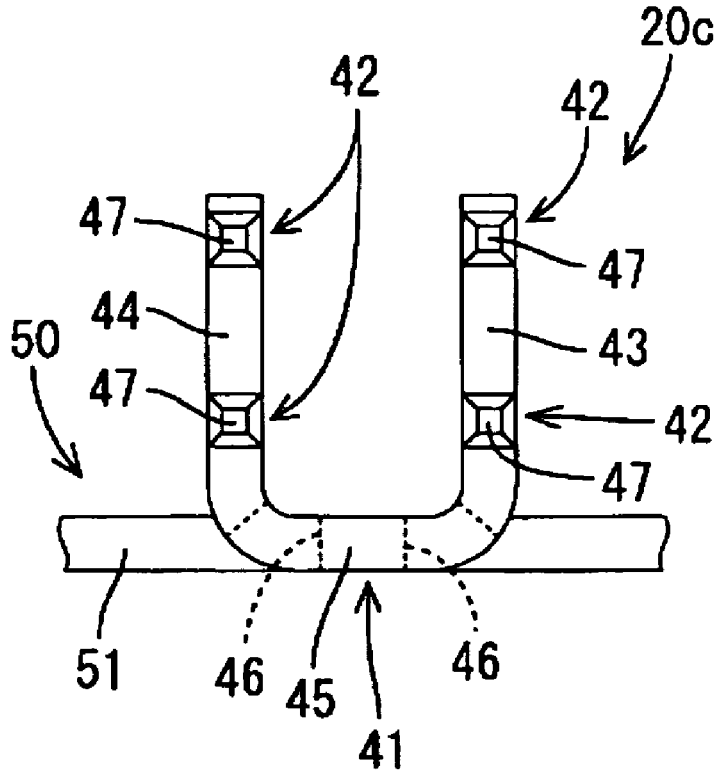
FIG. 11 is a front view showing the state where the coupling portion of the third joint terminal is bent in the chained terminals.
Figure 12:
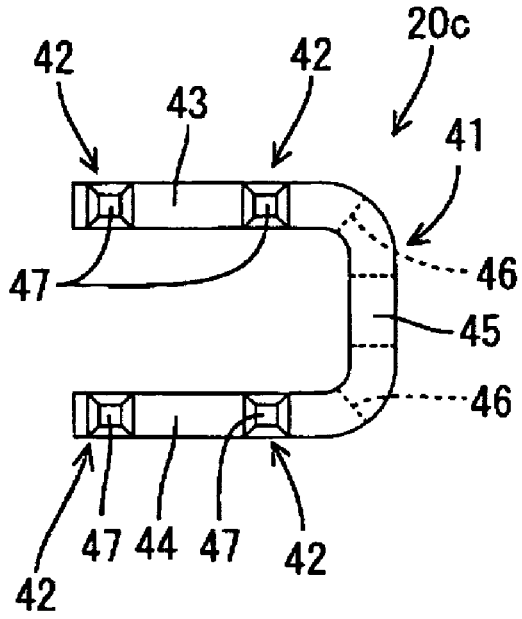
FIG. 12 is a front view of the third joint terminal.
Figure 13:
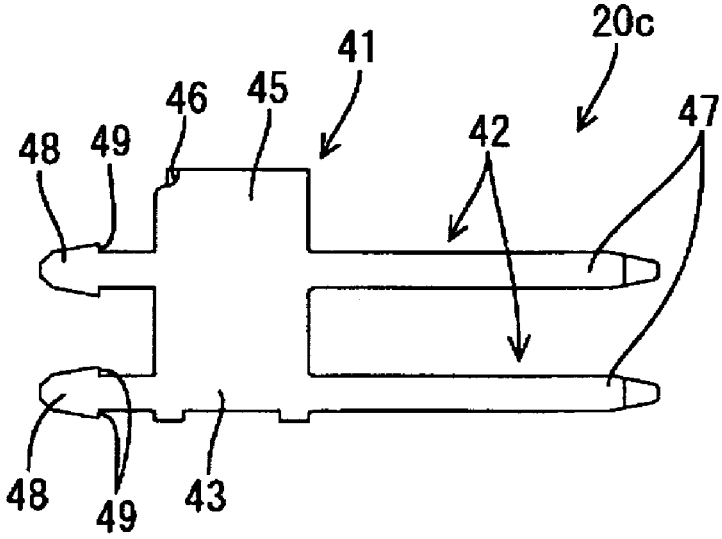
FIG. 13 is a plan view of the third joint terminal.
Figure 14:
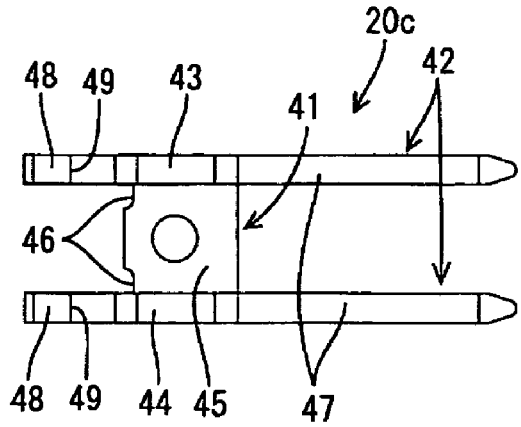
FIG. 14 is a side view of the third joint terminal.
Figure 15:
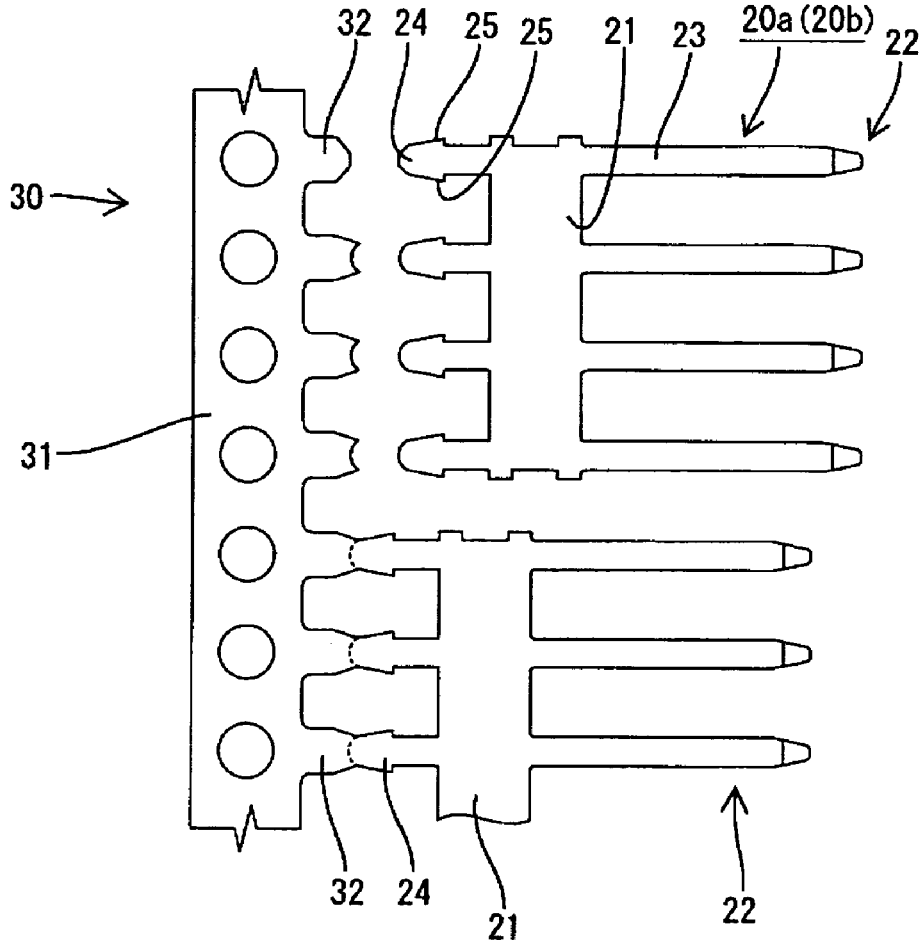
FIG. 15 is a plan view showing a state where a first or second joint terminal is cut off from chained terminals.

A joint connector according to the invention is described with reference to FIGS. 1 to 15. In the following description, a projecting direction of contact portions 23, 47 of tabs 22, 42 from a coupling portion 21, 41 is referred to as a forward direction FD, and reference is made to FIGS. 1 and 2(A) concerning transverse direction TD.

The joint connector has first to third joint terminals 20*a*, 20*b*, 20*c* mounted in a housing 10 made e.g. of a synthetic resin. The joint connector is to be connected with a mating connector (not shown) in which six unillustrated terminal fittings are arranged substantially side-by-side at specified intervals at each of upper and lower stages. The terms upper and lower are used herein for convenience of reference and do not imply a required gravitational orientation for any part of the joint connector. The joint connector is connected with the mating connector so that the three joint terminals 20*a*, 20*b*, 20*c* short the twelve terminal fittings in a specified pattern of three separate groups. Specifically as shown schematically in FIG. 2(B), four terminal fittings at the left side of the upper stage are shorted by the first joint terminal 20*a* to form a first terminal fitting group 1TFG; four terminal fittings at the left side of the lower stage are shorted by the second joint terminal 20*b* to form a second terminal fitting group 2TFG; and two terminal fittings at the right side of the upper stage and two terminal fittings at the right side of the lower stage are shorted by the third joint terminal 20*c* to form a third terminal fitting group 3TFG.

The housing 10 includes a fitting recess 11 configured to receive the mating connector from the front. A press-in groove 12 is formed in the back end surface of the fitting recess 11. The press-in groove 12 is comprised of an upper groove 13 in the form of a substantially horizontal slit, a lower groove 15 in the form of a substantially horizontal slit, and a vertical interconnecting groove 15 having upper and lower ends coupled to the right ends of the upper and lower grooves 13, 14. Connections between the vertical interconnecting groove 15 and the upper and lower grooves 13 and 14 are substantially arcuate. The width of the vertical groove 15 along the transverse direction TD exceeds the heights of the upper and lower grooves 13, 14. Slanted guiding surfaces 16 are formed at the opening edges of the grooves 13, 14, 15 facing the fitting recess 11.

Six narrow holding holes 17 open in the back end surface of each of the upper and lower grooves 13, 14 and extend back from this back end surface at specified horizontal intervals in the housing 10. The heights of the holding holes 17 substantially equal the heights of the upper and lower grooves 13, 14. Additionally the upper and lower surfaces of the holding holes 17 align substantially with the upper and lower surfaces of the corresponding upper and lower grooves 13 and 14. Long narrow ribs 18 of substantially semicircular cross section extend continuously along the forward direction FD on the upper and lower surfaces of the holding holes 17 and the upper and lower grooves 13 and 14. The ribs 18 extend from the front end of the respective upper or lower groove 13 or 14 to the rear end of the corresponding holding holes 17. Each rib 18 is narrower than the corresponding holding hole 17 and is in a widthwise middle of the holding hole 17. Additionally, the ribs 18 have slanted front surfaces that are substantially flush with the guiding surfaces 16.

The joint and second joint terminals 20*a*, 20*b* preferably have the substantially same shape and are obtained by separating chained terminals 30 at specified positions. The third joint terminal 20*c* is obtained by cutting chained terminals 50 after bending. Both chained terminals 30, 50 are supplied to an automatic mounting machine (not shown) for pressing the already-produced joint terminals 20*a*, 20*b*, 20*c* into the housing 10, and are fed intermittently substantially parallel with the longitudinal directions of respective carriers 31, 51. The first and second joint terminals 20*a*, 20*b* are separated from the chained terminals 30 without bending while the chained terminals are being fed intermittently. The third joint terminal 20*c* is bent and then separated from the chained terminals 50 while the chained terminals are being fed intermittently. The respective separated joint terminals 20*a*, 20*b*, 20*c* then are mounted into the housing 10.

The non-bending type of chained terminals 30 used to produce the first and second joint terminals 20*a*, 20*b* have a multitude of tabs 22 that project substantially side-by-side at specified intervals from one lateral edge of the long narrow carrier 31 of substantially constant width. All of the tabs 22 are coupled by a substantially constant width coupling 21 that is substantially parallel to the carrier 31. Each tab 22 has a narrow contact 23 that projects from a lateral edge of the coupling 21 opposite from the carrier 31 and a press-in portion 24 that extends from the coupling 21 to a lateral edge of the carrier 31. The contact 23 and the press-in portion 24 of each tab 22 extend along a substantially straight line. The contacts 23 and the press-in portions 24 are of substantially equal width, but the contacts 23 are longer than the press-in portions 24. Locks 25 project from the opposite lateral edges of the rear ends of the press-in portions 24 nearest the carrier 31, and the press-in portions 24 gradually narrow from the locks 25 towards the carrier 31. Protrusions 32 project from the lateral edge of the carrier 31 and are coupled to the ends of the press-in portions 24. The protrusions 32 gradually narrow towards the press-in portions 24.

The coupling 21 and the tabs 22 of each first and second joint terminal 20*a*, 20*b* are substantially flush with each other and substantially coplanar. The press-in portions 24 of the joint terminal 20*a*, 20*b* are cut at or near boundaries to the leading ends of the protrusions 32 so that the cut leading ends of the press-in portions 24 have substantially arcuate contours. Thus, the joint terminal 20*a*, 20*b* is separated from the carrier 31.

The cut-off first and second joint terminals 20*a*, 20*b* are pressed into the press-in groove 12. More particularly, the press-in portions 24 of each joint terminal 20*a*, 20*b* are pressed into the corresponding holding holes 17 and the coupling 21 is pressed in the upper or lower groove 13 or 14 while plastically deforming the ribs 18. As a result, the first and second joint terminals 20*a*, 20*b* are located at specified positions by the contact of the rear edges of the couplings 21 with the rear end surfaces of the upper and lower grooves 13, 14. Additionally, the locks 25 at the rear ends of the press-in portions 24 bite in the opposite left and right walls of the holding holes 17. Thus, the first and second joint terminals 20*a*, 20*b* are held so as not to come out. The contacts 23 of each joint terminal 20*a*, 20*b* are held to project forward in the fitting recess 11, and hence connectable with the terminal fittings.

The third joint terminal 20*c* has four tabs 42 that are coupled by a coupling 41 that is been bent into a substantially U-shape. The coupling 41 has a flat upper support 43 corresponding to the upper groove 13 of the press-in groove 12, a flat lower support 44 corresponding to the lower groove 14, and a substantially flat intermediate portion 45 corresponding to the vertical groove 15. The intermediate portion 45 of the coupling 41 has opposite upper and lower ends coupled respectively to the right ends of the upper and lower supports 43, 44. Corners between the intermediate portion 45 and the upper and lower supports 43, 44 are substantially arcuate. Two tabs 42 are supported on each of the upper and lower supports 43, 44, but no tab is supported on the intermediate portion 45. The third joint terminal 20*c* is an intermediate or bridging joint terminal that is to be arranged between two different stages of terminal fittings that are to be shored. Thus, the third joint terminal 20*c* bridges the first and second stages in a direction substantially normal to the arrangement direction AD in which the terminal fittings are arranged in each stage. The press-in portion 48 of the intermediate portion 45 may be left connected to the intermediate portion 28 while separating it from the carrier 51. Moreover, the first and second supports 43, 44 may be bent from the intermediate portion 45 in substantially opposite directions so that the third joint terminal 20*c* may have a flat S-shape. However, the first and second supports 43, 44 preferably are bent in the same direction from the intermediate portion 45, as shown, because the bending step is performed more easily.

The bending type chained terminals 50 have a substantially constant width carrier 51 and an extension 52 that projects unitarily and substantially at right angles from one lateral edge of the carrier 51. The extension 52 is substantially coplanar with portions of the carrier 51 adjacent thereto. The coupling 41 is coupled unitarily to the extension 52 so that the coupling is spaced from and substantially parallel to the carrier 51. Additionally the coupling 41 initially is substantially coplanar with the extension 52 and with portions of the carrier 51 adjacent the extension 52. The extension 52 gradually tapers towards the coupling 41. The projecting end of the extension 52 is coupled to a section of the coupling 41 that will define the intermediate portion 45 of the coupling 41. The projecting end of the extension 52 has a width that is equal to or slightly smaller than the width of the intermediate portion 45. A lateral edge of the coupling 41 towards the carrier 51 is cut out to form recesses 46 at sections of the coupling 41 that will define boundaries between the intermediate portion 45 and the upper and lower supports 43 and 44. Sections of the coupling 41 with the recesses 46 may be thinned or otherwise treated for allowing a better or increased bendability of the coupling 41 in this area. The inner edges of the recesses 46 are substantially continuous with the lateral edges of the extension 52 and are substantially in the same plane. Thus, the lateral edges of the extension 52 are adjacent to the recesses 46.

Two tabs 42 are supported on each of the upper and lower supports 43, 44. Each tab 42 has a narrow contact 47 projecting from a front edge of the upper or lower support 43, 44 substantially in the front direction FD and away from the carrier 51. Each tab 42 also has a narrow press-in portion 48 that projects from the rear edge of the upper or lower support 43, 44 towards the carrier 51. However, the press-in portions 48 do not contact the carrier 51. The contacts 47 and the press-in portions 48 are arranged substantially along a straight line. The contacts 47 and the press-in portions 48 are of substantially equal widths. However, the contacts 47 are longer than the press-in portions 48. Locks 49 project from opposite lateral edges of each press-in portion 48, and the press-in portions 48 gradually narrow from the locks 49 towards the back. The rear end of each press-in portion 48 has an arcuate contour.

The third joint terminal 20*c* is produced by employing a jig (not shown) to hold the extension 52 and the intermediate portion 45 of the coupling 41 from above and below, and hence in directions substantially normal to the plane containing the extension 52 and the intermediate portion 45. Accordingly, the extension 52 and the intermediate portion 45 are held substantially in the plane of the carrier 51. Portions of the coupling 41 at opposite sides of the intermediate portion 45 are bent at substantially right angles to the intermediate portion 45 in this held state to define the upper and lower supports 43, 44 (see FIGS. 10 and 11). The tabs 42 are supported on the upper and lower support 43, 44, and hence move with the upper and lower supports 43, 44. The bending forms the coupling 41 into a substantially U-shape with substantially arcuate corners. However, bending into an S-shape or other shape may be appropriate for some connectors. The intermediate portion 45 is separated along a cutting line 53 from the end of the extension 52 remote from the carrier 51. The cutting line 53 is inward from the rear edge of the coupling 41, and connects the inner edges of the recesses 46. In this way, the third joint terminal 20*c* is bent and cut off from the carrier 51 to complete the production thereof.

The third joint terminal 20*c* is pressed into the press-in groove 12 with the press-in portion 48 faced forward. At this time, the press-in portions 48 at each of the upper and lower stages pass the upper or lower groove 13 or 14 and are pressed individually into the holding holes 17 at the upper or lower stage while plastically deforming the ribs 18. Additionally, the coupling 41 is accommodated in the upper and lower grooves 13, 14. The coupling 41 is positioned with respect to forward and backward directions by the contact of the rear edge of the coupling 41 with the rear end surfaces of the upper and lower grooves 13, 14. The locks 49 at the rear ends of the press-in portions 48 bite into the opposite left and right walls of the holding holes 17. As a result, the third joint terminal 20*c* is held so as not to come out. The contacts 47 of the third joint terminal 20*c* project forward at upper and lower stages in the fitting recess 11, and hence are connectable with the terminal fittings. The intermediate portion 45 of the coupling portion 41 is accommodated in the vertical groove 15 that interconnects the two stages. The width of the vertical groove 15 is larger than the thickness of the intermediate portion 45, and there is a clearance between the intermediate portion 45 and the vertical groove 15. A bending error of the coupling 41 can be taken up by this clearance.

As described above, the joint terminals 20*a*, 20*b*, 20*c* and the housing 10 are united by the press-in operation instead of being united by insert molding. Thus, there is no likelihood that the joint terminals 20*a*, 20*b*, 20*c* are deformed by an injection pressure.

A leading section of the chained terminals with respect to feeding direction is bent twice to form the third joint terminal 20*c*. If this double bending method is applied to an automatic mounting machine for mounting already-produced joint terminals into housings, it is difficult to obtain a high dimensional precision. However, the upper and lower supports 43, 44 at opposite sides of the intermediate portion 45 of the coupling portion 41 are bent at substantially right angles to the intermediate portion 45 while the intermediate portion 45 is held flush or coplanar with the carrier 51. Thus, a high dimensional precision can be obtained even with an application to an automatic mounting machine for mounting the joint terminals into the housing 10.

The tabs 42 are separated from the carrier 51 in the bending type chained terminals 50 used to produce the third joint terminal 20*c*. Thus, a step of separating the tabs 42 from the carrier 51 is unnecessary upon bending the coupling 41.

Recesses 46 are formed at the boundary between the intermediate portion 45 and the upper and lower supports 43 and 44. Thus, bending resistance is reduced and the bending can be performed with high precision.

The extension 52 and the intermediate portion 45 are separated from each other along the cutting line connecting the inner sides of the recesses 46 after the coupling 41 is bent. Thus, the cut surface of the coupling 41 is at the inner sides of the recesses 46 and more inward than the lateral edge of the coupling 41. Therefore, any burrs created on the cutting surface do not project out beyond the lateral edge of the coupling 41.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Two tabs are provided at each of the upper and lower stages in the third joint terminal of the foregoing embodiment. However, one, three or more tabs may be provided at both stages according to the invention. A third joint terminal with only one tab at one stage may have a substantially L-shape.

Although the tabs project from the front and rear edges of the coupling by crossing the coupling in the foregoing embodiment, the tabs may project only from the front edge of the coupling according to the invention.

Although the number of the terminal fittings is twelve in the foregoing embodiment, it may eleven or less or thirteen or more.

The terminal fittings are shorted while being divided into three groups in the foregoing embodiment. However, a shorting pattern to divide the terminal fittings into two, four or more groups may be adopted.

Recesses are formed at the boundary between the intermediate portion and the upper and lower supports in the foregoing embodiment. However, no recess may be formed.

Lateral edges of the extension are adjacent the recesses in the foregoing embodiment. However, the recesses may be spaced from the extension.

The third joint terminal may couple terminal fittings on stages separated from each other by other stages. In such a case, the intermediate portion has a length that substantially corresponds to the distance separating the stages to be coupled.

What is claimed is:

1. A joint connector for shorting terminal fittings in a mating connector that has terminals at least at first and second stages, the joint connector comprising:

a housing having opposite front and rear ends, a fitting recess extending into the front end and configured for receiving the mating connector, first and second grooves formed in a rear wall of the fitting recess at locations corresponding to the first and second stages of the mating connector, an interconnecting groove formed in the rear wall of the fitting recess and extending between the first and second grooves, holding holes extending rearwardly in the first and second grooves; and at least one joint terminal mounted in the housing, the joint terminal having a coupling with an intermediate portion disposed in the interconnecting groove of the housing, a first support extending angularly and unitarily from a first part of the intermediate portion and disposed in the first groove of the housing, the first support supporting a plurality of first tabs extending in a first direction substantially parallel to a longitudinal central axis and disposed at positions corresponding to respective positions of terminals at the first stage and a second support extending angularly and unitarily from a second part of the intermediate portion and disposed in the second groove of the housing, the second support supporting a plurality of second tabs extending in the first direction substantially parallel to the longitudinal central axis and disposed at positions corresponding to the terminals at the second stage of the mating housing, the joint terminal further having a plurality of first pressing portions and a plurality of second pressing portion extending in a second direction from the respective first and second supports, the second direction being substantially opposite to the first direction, the pressing portion being aligned substantially parallel to the longitudinal central axis.

2. The joint connector of claim 1, wherein the first and second supports are bent relative to the intermediate portion so that the coupling defines a substantially U-shape.

* * * * *